US011268383B2

(12) United States Patent
Guo et al.

(10) Patent No.: US 11,268,383 B2
(45) Date of Patent: Mar. 8, 2022

(54) TYPE OF ENERGY-ABSORBING ROCK BOLT DEVICE WITH UMBRELLA-SHAPED STRUCTURE

(71) Applicant: Institute Of Geology And Geophysics, Chinese Academy Of Sciences, Beijing (CN)

(72) Inventors: Songfeng Guo, Beijing (CN); Shengwen Qi, Beijing (CN); Shishu Zhang, Sichuan (CN); Xingdong Ma, Sichuan (CN); Guoqing Yuan, Sichuan (CN); Xiuhua Wang, Sichuan (CN); Bowen Zheng, Beijing (CN); Yu Zou, Beijing (CN); Xiaolin Huang, Beijing (CN); Ning Liang, Beijing (CN); Hang Li, Chengdu (CN); Yubo Liu, Chengguan Town (CN); Jianxian He, Beijing (CN); Xianglong Yao, Beijing (CN); Daping Tai, Beijing (CN); Guangming Luo, Beijing (CN)

(73) Assignee: INSTITUTE OF GEOLOGY AND GEOPHYSICS, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 17/167,363

(22) Filed: Feb. 4, 2021

(65) Prior Publication Data

US 2022/0010681 A1 Jan. 13, 2022

(30) Foreign Application Priority Data

Jul. 9, 2020 (CN) ..... 202010654811.9

(51) Int. Cl.
*E21D 21/00* (2006.01)

(52) U.S. Cl.
CPC ..... *E21D 21/0046* (2013.01); *E21D 21/008* (2013.01)

(58) Field of Classification Search
CPC ..... E21D 21/0046; E21D 21/008; E21D 21/0026; E21D 21/0066
See application file for complete search history.

(56) References Cited

U.S. PATENT DOCUMENTS 3,017,799 A * 1/1962 Lemoine ..... F16B 13/068 411/56
3,528,253 A * 9/1970 Kovacs ..... E21D 21/008 411/60.3
4,305,687 A * 12/1981 Parker ..... E21D 21/0046 405/259.3

(Continued)

*Primary Examiner* — Benjamin F Fiorello
(74) *Attorney, Agent, or Firm* — WPAT, PC

(57) ABSTRACT

The present invention discloses a type of energy-absorbing rock bolt device with umbrella-shaped structure, which consists of a body of bolt, and one end of the said body of bolt is equipped with a preloaded system, as well as the other end of the said body of bolt is equipped with the first support system, in addition, the said body of bolt is equipped with several second support systems, and the said second support system is located between the said preloaded system and the said first support system; meanwhile, the said second support system consists of the first umbrella-shaped support system and the second umbrella support system.

13 Claims, 2 Drawing Sheets

(56) References Cited

U.S. PATENT DOCUMENTS

| | | | | |
|---|---|---|---|---|
| 4,534,680 | A * | 8/1985 | White | E21D 20/025 405/259.3 |
| 5,076,734 | A * | 12/1991 | Hipkins, Sr. | E21D 21/0026 405/259.5 |
| 5,211,512 | A * | 5/1993 | Frischmann | F16B 13/065 405/259.4 |
| 5,350,024 | A * | 9/1994 | Gruber | E21B 17/0426 166/242.6 |
| 9,512,720 | B2 * | 12/2016 | Faulkner | F16J 15/06 |
| 9,829,026 | B2 * | 11/2017 | Andou | F16B 13/065 |
| 2009/0041550 | A1 * | 2/2009 | Oldsen | E21D 21/008 405/259.3 |
| 2009/0133933 | A1 * | 5/2009 | Karpellus | E21D 21/008 175/57 |
| 2017/0152879 | A1 * | 6/2017 | Andou | E21D 21/0026 |
| 2020/0056479 | A1 * | 2/2020 | Xu | E21D 20/003 |

* cited by examiner

TYPE OF ENERGY-ABSORBING ROCK BOLT DEVICE WITH UMBRELLA-SHAPED STRUCTURE

FIELD OF THE INVENTION

The present invention relates to the fields of rock mass mechanics and engineering geology, particularly to a type of energy-absorbing rock bolt device with umbrella-shaped structure.

BACKGROUND OF THE INVENTION

Rock bolt is a kind of support system which transfers tensile load to stable rock-soil stratum to improve the stability and strength of rock-soil medium. Qian Qihu, a member of the Chinese Academy of Engineering and the winner of the Top National Award for Science and Technology, once said: The 21st century is the century belongs to underground engineering. For the past few years, with the planning and implementation of national critical projects including mining, geological disposal of nuclear waste, hydropower development in the western area, and the Sichuan-Tibet railway, etc., the buried depth of the project has gradually deepened, which reaches kilometric level, and the ground stress reaches dozens of MPa. During the excavation process, the conditions of increase of tangential stress and radial unloading occurs in the surrounding rock within a certain range, and cracks initiate, propagate and coalesce, and thus form a plastic zone, so that eventually cause surrounding rock failures such as rock bursts and large deformations, etc., and bring about enormous economic losses. Traditional rock bolt cannot produce satisfying effect in the process of surrounding rock consolidation. It cannot realize the control of the progressive failure of the rock mass, and thus leads to the conditions of snap of rock bolt, or slippage failure between the rock bolt and the Qihoo wall of hole occurred in rock burst and cavern support with large deformation surrounding rock. Such special deformation and failure of surrounding rock resulted from these deep high ground stress put forward higher requirements on rock bolt support, which requires high strength and elongation under dynamic and static loads, meanwhile, such rock bolt will produce transverse expansion effect when the axial tension and deformation of rock bolt occurs, and can tightly combined with the wall of hole to achieve the purpose of absorbing energy and optimizing consolidation. Therefore, a type of energy-absorbing rock bolt device with umbrella-shaped structure is required to address the problems existed in the prior art.

SUMMARY OF THE INVENTION

The purpose of the present invention is to provide a type of energy-absorbing rock bolt device with umbrella-shaped structure to address aforesaid problems existed in the prior art, and thus, makes the rock bolt have higher strength and elongation under the dynamic and static load resulted from the rock burst and cavern support with large deformation surrounding rock, and increase impedance simultaneously to achieve the purpose of energy absorption.

In order to achieve the aforesaid purpose, the present invention provides following scheme: the present invention provides a type of energy-absorbing rock bolt device with umbrella-shaped structure, which consists of a body of bolt, and one end of the said body of bolt is equipped with a preloaded system, as well as the other end of the said body of bolt is equipped with the first support system, in addition, the said body of bolt is equipped with several second support systems, and the said second support system is located between the said preloaded system and the said first support system;

The said second support system consists of the first umbrella-shaped support system and the second umbrella support system;

The end of the said first umbrella-shaped support system close to the said preloaded system is fixedly connected to the said body of bolt, and the end of the said first umbrella-shaped support system far away from the said preloaded system is threadedly connected to the said body of bolt; as well as the said second umbrella-shaped support system is threadedly connected to the said body of bolt.

Preferably, the said first umbrella-shaped support system consists of the first fixed block, the first nut and the first interconnecting piece, and the said first fixed block is muff-coupled with the said body of bolt, wherein, both sides of the said first fixed block are equipped with shoulders, and the said shoulders are fixedly connected to the said body of bolt, in addition, the said first nut is threadedly connected to the said body of bolt, and the said first interconnecting piece consists of the first connecting rod and the second connecting rod. Wherein, there is a sliding sleeve is slidingly connected to the said second connecting rod, and the said sliding sleeve is articulated to one end of the said first connecting rod, and the other end of the said first connecting rod is articulated to the said first nut, as well as the said second connecting rod is articulated to the said first fixed block.

Preferably, the said second umbrella-shaped support system consists of the second nut, the third nut and the second interconnecting piece, wherein, the said second nut and the third nut are respectively threadedly connected to the said body of bolt, and the said second interconnecting piece consists of the third connecting rod, the fourth connecting rod, and the fifth connecting rod as well as the sixth connecting rod, wherein, one end of the said third connecting rod and the sixth connecting rod are respectively articulated to the said second nut and the third nut, and the said third connecting rod, the fourth connecting rod, the fifth connecting rod and the sixth connecting rod are respectively connected end to end in sequence.

Preferably, the internal threads arranged on the said first nut and the third nut are in the same direction, and the internal threads arranged on the said second nut and the third nut are in the opposite direction.

Preferably, there are Y-shaped support frames are symmetrically arranged at the articulation point of the said third connecting rod, the fourth connecting rod and the articulation point of the said fifth connecting rod and the sixth connecting rod, and there is a conical block is arranged at the articulation point of the said fourth connecting rod and the fifth connecting rod, meanwhile, the said Y-shaped support frame and the conical block are all arranged radially based upon taking the shaft axis of the body of bolt as the center.

Preferably, the first interconnecting piece and the second interconnecting piece are all arranged in a circular array based upon taking the shaft axis of the body of bolt as the center.

Preferably, the said first support system consists of the second fixed block, and there are expansion shell pieces are symmetrically arranged on the upper and lower sides of the said second fixed block, in addition, there are U-shaped shackles are fixedly connected to the outside of two said expansion shell pieces, and two said expansion shell pieces are integrated together via the said U-shaped shackles, meanwhile, the outside of the said U-shaped shackle is fastened with strapping tape, and the said second fixed block is fixedly connected to the said body of bolt, as well as the outside of the said second fixed block is opened a conical surface, in addition, the end of the said expansion shell piece close to the said second fixed block is matched with the said conical surface, and there are internal threads are arranged on the inner side of the said expansion shell piece, as well as there are external threads are arranged on the outside of the said second fixed block, and the said internal threads are matched with the said external threads, and there are several wedge blocks are fixedly connected to the intervals on the outside of the said expansion shell piece.

Preferably, there is a through hole is opened on the left side of the said U-shaped shackle, and there are a spring and a steel ball are symmetrically arranged on the upper and lower sides of the said through hole, meanwhile, one end of the said spring is fixedly connected to the side surface of the said through hole, and the other end of the said spring is fixedly connected to the said steel ball, in addition, the said body of bolt passes through the said through hole, and there is a circular groove is opened on the end of the said body of bolt close to the said U-shaped shackle, as well as the said circular groove is matched with the said steel ball.

Preferably, the said preloaded system consists of a supporting plate, the fifth nut, and the said supporting plate is fixedly connected to the said body of bolt, and the said fifth nut is threadedly connected to the said body of bolt.

Preferably, the end of the said body of bolt far away from the said supporting plate is fixedly connected with a resin stirrer.

The present invention discloses following technical effects:

The present invention by means of equipping the first support system and fixedly connecting it to the body of bolt via the second fixed block, and then the body of bolt rotates to drive the second fixed block to rotate, and the second fixed block slides into the inner side of the expansion shell piece firstly through the conical surface, and thus realizes gradually support of the expansion shell piece by the second fixed block through threadedly connecting the outer side of the second fixed block with the inner side of the expansion shell piece, in addition, the present invention by virtue of bracing the surrounding rock via the expansion shell piece to realize the first support of the rock bolt to the surrounding rock. Meanwhile, it realizes the fixing of the U-shaped shackle through squeezing the U-shaped shackle on the surrounding rock completely via the expansion shell piece. During the process that the body of bolt drives the second fixed block to support the expansion shell piece, the body of bolt moves outwards for a certain distance integrally, and after the second fixed block fully braces the expansion shell piece, the circular groove at the end of the body of bolt is just got stuck on the steel ball in the through hole of the U-shaped shackle, and thus, realizes the rotational connection between the end of the body of bolt and the U-shaped shackle;

Furthermore, the present invention by virtue of equipping the second support system, and rotating the first nut, the second nut and the third nut prior to inserting the rock bolt into the hole of the surrounding rock hole to assemble the first interconnecting piece and the second interconnecting piece. After the rock bolt being inserted into the surrounding rock hole, due to the end of the body of bolt connected to the U-shaped shackle has formed a rotational connection with the U-shaped shackle, the rotation of the body of bolt can be realized by rotating the end of the body of bolt outside the hole of the surrounding rock. In addition, when the body of bolt rotates, the first nut, the second nut and the third nut are driven to move on the body of bolt. Due to the internal threads arranged on the first nut and the third nut are in the same direction, and the internal threads arranged on the second nut and the third nut are in the opposite direction, and thus, makes the umbrella-type part of the first and second interconnecting pieces open, and the second connecting rod of the first interconnecting piece squeeze into the surrounding rock layer, as well as the conical block fixedly connected on the second interconnecting piece insert into the surrounding rock, so that realizes the second support to the surrounding rock;

When rock burst or cavern support with large deformation surrounding rock occurs, the rock bolt may experience axial deformation. Due to the axial deformation can drive the second nut and the third nut to do slight separation movement, the third connecting rod passing through the second interconnecting piece will produce a radial squeezing force on the fourth connecting rod, and thus, makes the umbrella-type part brace larger, meanwhile, the Y-shaped support frame will also produce support force to the surrounding rock, and thus forms the third support to the surrounding rock when the rock bolt deforms;

Due to the umbrella-shaped part braces larger, the umbrella-shaped support structure producing a structural deformation similar to the Negative Poisson's Ratio can be realized when the rock bolt described in the present invention is deformed, and the impedance increases at the same time.

BRIEF DESCRIPTION OF THE FIGURES

For the purpose of explaining the embodiments of the present invention or the technical scheme in the prior art more clearly, the text below will briefly describe the drawings that need to be used in the embodiments. It is obviously that the drawings described below are only some of the embodiments of the present invention, for those of ordinary skill in the art, other drawings can be obtained based on these drawings without paying creative labor.

Wherein, 1 is the body of bolt, 2 is the first support system, 3 is the second support system, 4 is the preloaded system, and 1.1 is the circular groove, 2.1 is the second fixed block, 2.2 is the expansion shell piece, 2.3 is the U-shaped shackle, 2.4 is the strapping tape, 2.2.1 is the wedge block, 2.3.1 is the through hole, 2.3.2 is the spring, 2.3.3 is the steel ball, and 3.1 is the first fixed block, 3.2 is the shoulder, 3.3 is the first nut, 3.4 is the first connecting rod, 3.5 is the second connecting rod, 3.6 is the sliding sleeve, 3.7 is the second nut, 3.8 is the third nut, 3.9 is the third connecting rod, 3.10 is the fourth connecting rod, 3.11 is the fifth connecting rod, 3.12 is the sixth connecting rod, and 3.13 is the Y-shaped support frame, 3.14 is the conical block, 4.1 is the support plate, and 4.2 is the fourth nut.

DESCRIPTION OF THE INVENTION

The text below will describe the technical scheme of the embodiments of the present invention clearly and completely in conjunction with the accompanying drawings of the embodiments of the present invention. It is obviously that the described embodiments are only some of the embodiments of the present invention, rather than all the embodiments. Based on the embodiments of the present invention, all other embodiments obtained by those of ordinary skill in the art without paying creative labor shall fall within the protection scope of the present invention.

In order to make the aforesaid purposes, features and advantages of the present invention clearly and ease to understand, the text below will further describe the present invention in detail in conjunction with the accompanying drawings and specific embodiments.

Figure 1:
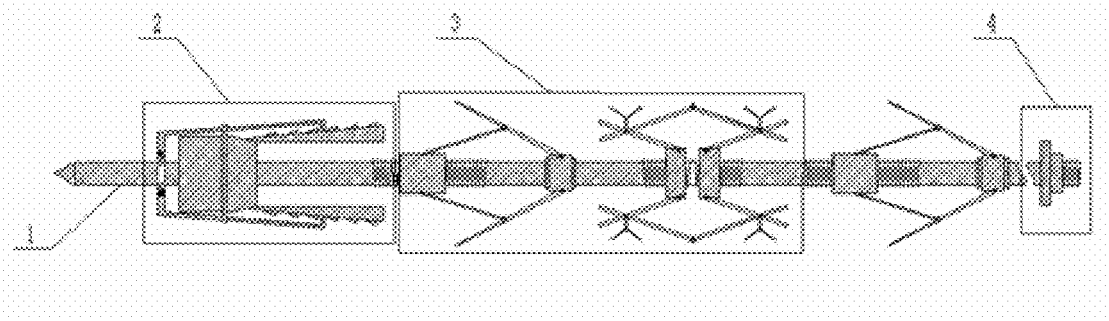
FIG. 1 is a schematic diagram of a type of energy-absorbing rock bolt device with umbrella-shaped structure of the present invention.
Figure 2:
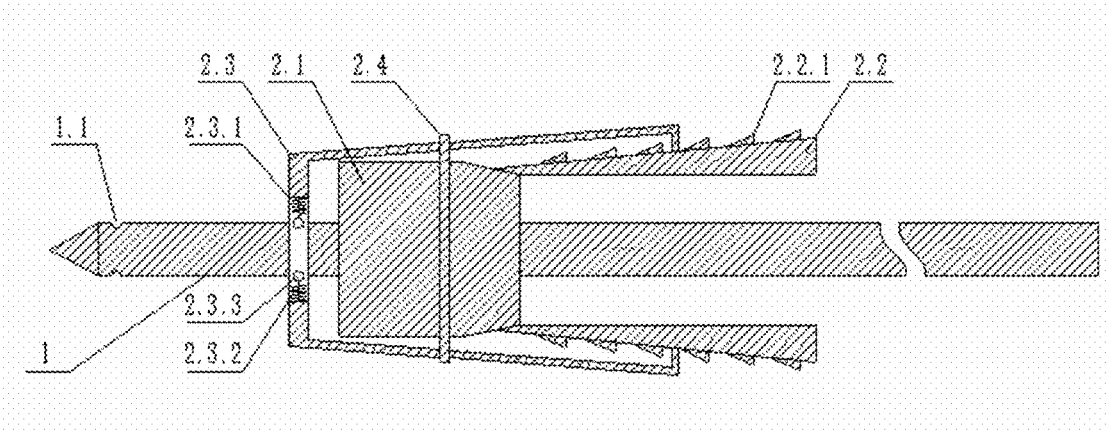
FIG. 2 is a schematic diagram of the first support system and the body of bolt.
Figure 3:
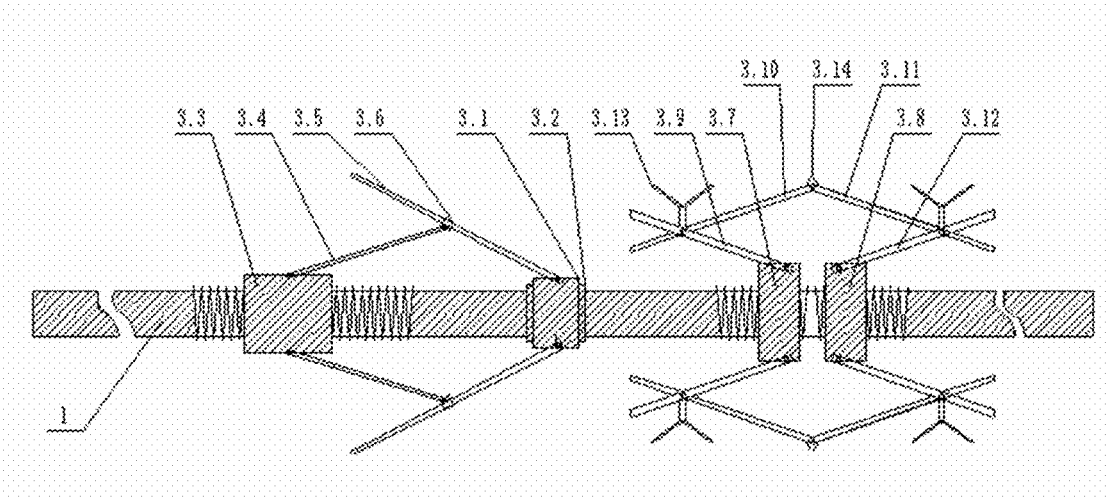
FIG. 3 is a schematic diagram of the second support system and the body of bolt.
Figure 4:
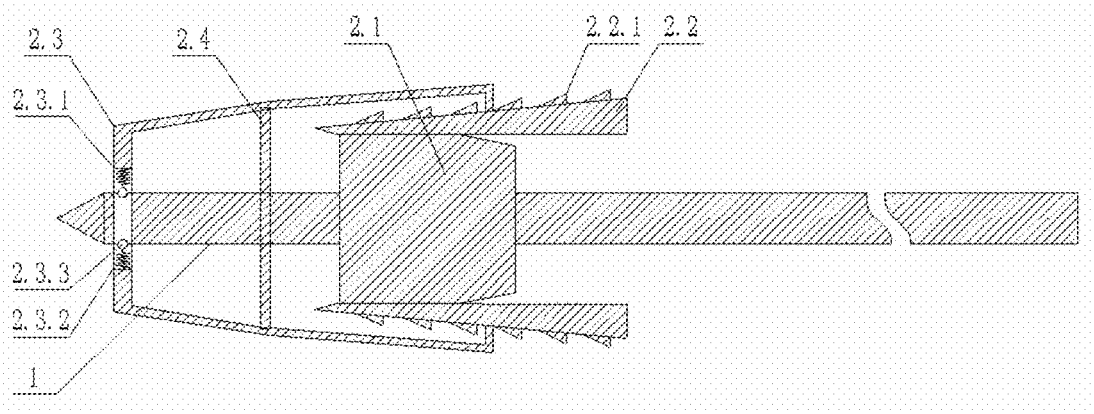
FIG. 4 is a schematic diagram of the second fixed block in the first support system supports the expansion shell piece.
Figure 5:
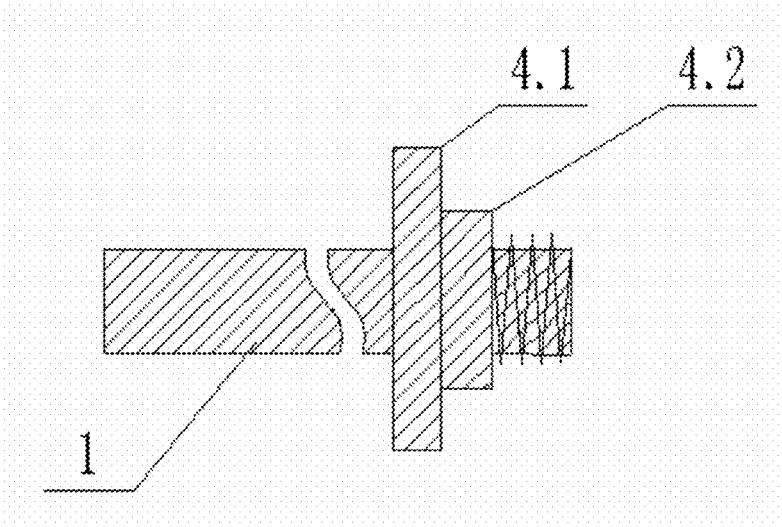
FIG. 5 is a schematic diagram of the preloaded system and body of bolt.

With reference to FIGS. 1-5, the present invention provides a type of energy-absorbing rock bolt device with umbrella-shaped structure, which consists of a body of bolt 1, and one end of the said body of bolt 1 is equipped with a preloaded system 4, as well as the other end of the said body of bolt 1 is equipped with the first support system 2, in addition, the said body of bolt 1 is equipped with several second support systems 3, and the said second support system 3 is located between the said preloaded system 4 and the said first support system 2;

The said second support system 3 consists of the first umbrella-shaped support system and the second umbrella support system;

The end of the said first umbrella-shaped support system close to the said preloaded system 4 is fixedly connected to the said body of bolt 1, and the end of the said first umbrella-shaped support system far away from the said preloaded system 4 is threadedly connected to the said body of bolt 1; as well as the said second umbrella-shaped support system is threadedly connected to the said body of bolt 1.

In a further preferred embodiment, the said first umbrella-shaped support system consists of the first fixed block 3.1, the first nut 3.3 and the first interconnecting piece, and the said first fixed block 3.1 is muff-coupled with the said body of bolt 1, wherein, both sides of the said first fixed block 3.1 are equipped with shoulders 3.2, and the said shoulders 3.2 are fixedly connected to the said body of bolt 1, in addition, the said first nut 3.3 is threadedly connected to the said body of bolt 1, and the said first interconnecting piece consists of the first connecting rod 3.4 and the second connecting rod 3.5. Wherein, there is a sliding sleeve 3.6 is slidingly connected to the said second connecting rod 3.5, and the said sliding sleeve 3.6 is articulated to one end of the said first connecting rod 3.4, and the other end of the said first connecting rod 3.4 is articulated to the said first nut 3.3, as well as the said second connecting rod 3.5 is articulated to the said first fixed block 3.1.

In a further preferred embodiment, the said second umbrella-shaped support system consists of the second nut 3.7, the third nut 3.8 and the second interconnecting piece, wherein, the said second nut 3.7 and the third nut 3.8 are respectively threadedly connected to the said body of bolt 1, and the said second interconnecting piece consists of the third connecting rod 3.9, the fourth connecting rod 3.10, and the fifth connecting rod 3.11 as well as the sixth connecting rod 3.12, wherein, one end of the said third connecting rod 3.9 and the sixth connecting rod 3.12 are respectively articulated to the said second nut 3.7 and the third nut 3.8, and the said third connecting rod 3.9, the fourth connecting rod 3.10, the fifth connecting rod 3.11 and the sixth connecting rod 3.12 are respectively connected end to end in sequence.

In a further preferred embodiment, the internal threads arranged on the said first nut 3.3 and the third nut 3.8 are in the same direction, and the internal threads arranged on the said second nut 3.7 and the third nut 3.8 are in the opposite direction.

In a further preferred embodiment, there are Y-shaped support frames 3.13 are symmetrically arranged at the articulation point of the said third connecting rod 3.9, the fourth connecting rod 3.10 and the articulation point of the said fifth connecting rod 3.11 and the sixth connecting rod 3.12, and there is a conical block 3.14 is arranged at the articulation point of the said fourth connecting rod 3.10 and the fifth connecting rod 3.11, meanwhile, the said Y-shaped support frame 3.13 and the conical block 3.14 are all arranged radially based upon taking the shaft axis of the body of bolt 1 as the center. When the umbrella-shaped structure of the second interconnecting piece opens, both the wedge block 3.14 and the Y-shaped support frame 3.13 will produce squeezing and support effect on the hole of the surrounding rock.

In a further preferred embodiment, the first interconnecting piece and the second interconnecting piece are all arranged in a circular array based upon taking the shaft axis of the body of bolt 1 as the center.

In a further preferred embodiment, the said first support system 2 consists of the second fixed block 2.1, and there are expansion shell pieces 2.2 are symmetrically arranged on the upper and lower sides of the said second fixed block 2.1, in addition, there are U-shaped shackles 2.3 are fixedly connected to the outside of two said expansion shell pieces 2.2, and two said expansion shell pieces 2.2 are integrated together via the said U-shaped shackles 2.3, meanwhile, the outside of the said U-shaped shackle 2.3 is fastened with strapping tape 2.4, and the said second fixed block 2.1 is fixedly connected to the said body of bolt 1, as well as the outside of the said second fixed block 2.1 is opened a conical surface, in addition, the end of the said expansion shell piece 2.2 close to the said second fixed block 2.1 is matched with the said conical surface, and there are internal threads are arranged on the inner side of the said expansion shell piece 2.2, as well as there are external threads are arranged on the outside of the said second fixed block 2.1, and the said internal threads are matched with the said external threads, and there are several wedge blocks 2.2.1 are fixedly connected to the intervals on the outside of the said expansion shell piece 2.2.

In a further preferred embodiment, there is a through hole 2.3.1 is opened on the left side of the said U-shaped shackle 2.3, and there are a spring 2.3.2 and a steel ball 2.3.3 are symmetrically arranged on the upper and lower sides of the said through hole 2.3.1, meanwhile, one end of the said spring 2.3.2 is fixedly connected to the side surface of the said through hole 2.3.1, and the other end of the said spring 2.3.2 is fixedly connected to the said steel ball 2.3.3, in addition, the said body of bolt 1 passes through the said through hole 2.3.1, and there is a circular groove 1.1 is opened on the end of the said body of bolt 1 close to the said U-shaped shackle 2.3, as well as the said circular groove 1.1 is matched with the said steel ball 2.3.3. In addition, the body of bolt 1 rotates outwards to drive the second fixed block 2.1 to rotate, and the second fixed block 2.1 slides into the inner side of the expansion shell piece 2.2 firstly through the conical surface, and thus realizes gradually support of the expansion shell piece 2.2 by the second fixed block 2.1 through threadedly connecting the outer side of the second fixed block 2.1 with the inner side of the expansion shell piece 2.2, furthermore, the embodiment by virtue of bracing the surrounding rock via the expansion shell piece 2.2 to realize the first support of the rock bolt to the surrounding rock. Meanwhile, it realizes the fixing of the U-shaped shackle 2.3 through squeezing the U-shaped shackle 2.3 on the surrounding rock completely via the expansion shell piece 2.2. During the process that the body of bolt 1 drives the second fixed block 2.1 to support the expansion shell piece 2.2, the body of bolt 1 moves outwards for a certain distance integrally, and after the second fixed block 2.1 fully braces the expansion shell piece 2.2, the circular groove 1.1 at the end of the body of bolt 1 is just got stuck on the steel ball 2.3.3 in the through hole 2.3.1 of the U-shaped shackle 2.3, and thus, realizes the rotational connection between the end of the body of bolt 1 and the U-shaped shackle 2.3;

In a further preferred embodiment, the preloaded system 4 consists of a supporting plate 4.1 and the fourth nut 4.2, wherein, the said supporting plate 4.1 is fixedly connected to the said body of bolt 1, and the said fourth nut 4.2 is threadedly connected to the said body of bolt 1, and thus makes the fourth nuts 4.2 compress the support plate by rotating the fourth nuts 4.2, so that realizes the fixing of the whole body of bolt through pressing the surrounding rock by the support plate.

In a further preferred embodiment, the end of the said body of bolt 1 far away from the supporting plate 4.1 is fixedly connected with a resin stirrer. After inserting the rock bolt into the hole of the surrounding rock integrally, pours cement mortar or resin anchoring cartridge into the hole of the surrounding rock, and stirs them well with the resin stirrer to facilitate solidification.

The operating principle of a type of energy-absorbing rock bolt device with umbrella-shaped structure of the present invention is:

To screw the first nut 3.3, the second nut 3.7 and the third nut 3.8 prior to inserting the rock bolt 1 into the hole of the surrounding rock firstly. Due to the first nut 3.3 is articulated to the first connecting rod 3.4, the second connecting rod 3.5 is slidably connected to the second connecting rod 3.5 via the sliding sleeve 3.6, and the second connecting rod 3.5 is articulated to the first fixed block 3.1, the shoulders 3.2 on both sides of the first fixed block 3.1 can get the first fixed block 3.1 stuck on the body of bolt 1, and thus, realize the first fixed block 3.1 can only conduct axial rotation along the body of bolt 1, and then, make the first connecting rod 3.4 assemble with the second connecting rod 3.5 by screwing the first nut 3.3. Meanwhile, due to the third connecting rod 3.9 and the fourth connecting rod 3.10 are respectively articulated to the second nut 3.7, the third nut 3.8, and the third connecting rod 3.9, the fourth connecting rod 3.10, the fifth connecting rod 3.11, and the sixth connecting rod 3.12 are articulated end to end, the third connecting rod 3.9, the fourth connecting rod 3.10, the fifth connecting rod 3.11, and the sixth connecting rod 3.12 can be assembled together by screwing the second nut 3.7 and the third nut 3.8. After the first umbrella support system and the second umbrella support system are assembled, the body of bolt 1 can be easily inserted into the hold of the surrounding rock, and thus, make the body of bolt 1 rotate. After that, the body of bolt 1 rotates outward to drive the second fixed block 2.1 to rotate, and the second fixed block 2.1 slides into the inner side of the expansion shell piece 2.2 through the conical surface firstly and then realizes gradually support of the expansion shell piece 2.2 by the second fixed block 2.1 through threadedly connecting the outer side of the second fixed block 2.1 with the inner side of the expansion shell piece 2.2, in addition, the present invention by virtue of bracing the surrounding rock via the expansion shell piece 2.2 to realize the first support of the rock bolt to the surrounding rock. Meanwhile, it realizes the fixing of the U-shaped shackle 2.3 through squeezing the U-shaped shackle 2.3 on the surrounding rock on the wall of hole completely via the expansion shell piece 2.3. In addition, binds the U-shaped shackle 2.3 with the upper and lower expansion shell pieces 2.2 by using the strapping tape 2.4 to bind at the outside of the U-shaped shackle 2.3, and the cable strapping tape 2.4 will be broken when the expansion shell piece 2.2 squeezes the U-shaped shackle 2.3. Furthermore, during the process that the body of bolt 1 drives the second fixed block 2.1 to support the expansion shell piece 2.2, the body of bolt 1 moves outwards for a certain distance integrally, and after the second fixed block 2.1 fully braces the expansion shell piece 2.2, the circular groove 1.1 at the end of the body of bolt 1 is just got stuck on the steel ball 2.3.3 in the through hole 2.3.1 of the U-shaped shackle 2.3, and thus, realizes the rotational connection between the end of the body of bolt 1 and the U-shaped shackle 2.3; after that, due to the end of the body of bolt connected to the U-shaped shackle has formed a rotational connection with the U-shaped shackle after the rock bolt being inserted into the surrounding rock hole, the rotation of the body of bolt 1 at the same position (i.e., in the through hole 2.3.1 of the U-shaped shackle 2.3) can be realized by rotating the end of the body of bolt outside the hole of the surrounding rock. In addition, when the body of bolt 1 rotates, the first nut 3.3, the second nut 3.7 and the third nut 3.8 are driven to move on the body of bolt 1. Due to the internal threads arranged on the first nut 3.3 and the third nut 3.8 are in the same direction, and the internal threads arranged on the second nut 3.7 and the third nut 3.8 are in the opposite direction, and thus, makes the umbrella-type part of the first and second interconnecting pieces open, and the second connecting rod 3.5 of the first interconnecting piece squeeze into the surrounding rock layer, as well as the conical block 3.14 fixedly connected on the second interconnecting piece insert into the surrounding rock, so that realizes the second support to the surrounding rock of the wall of hole; and then, to rotate the fourth nut 4.2 and make the fourth nut 4.2 compress the support plate, and thus, realizes the fixing of the whole body of bolt through pressing the surrounding rock of the wall of hole by the support plate.

When rock burst or cavern support with large deformation surrounding rock occurs, the rock bolt may experience axial deformation. Due to the axial deformation can drive the second nut 3.7 and the third nut 3.8 to do slight separation movement, the third connecting rod 3.9 passing through the second interconnecting piece will produce a radial squeezing force on the fourth connecting rod along the body of bolt 1, and thus, makes the umbrella-type part brace larger, meanwhile, the Y-shaped support frame 3.13 will also produce support force to the surrounding rock of the wall of hole, and thus forms the third support to the surrounding rock when the rock bolt deforms.

In the description of the present invention, it should be understood that the orientation or positional relationship indicated by the terms of "longitudinal", "lateral", "upper", "lower", "front", "rear", "left", "right", "vertical", "horizontal", "top", "bottom", "inner" and "outer", etc. is the orientation or positional relationship based upon those shown in the accompanying drawings, which are only used for the convenience of describing the present invention, rather than indicating or implying that the device or element referred to must have a specific orientation, or be configured and operated in a specific orientation, and therefore cannot be constructed as a limitation of the present invention.

The aforesaid embodiments only describe the preferred embodiments of the present invention, rather than limiting the scope of the present invention. Any variations and improvements of the technical scheme of the present invention made by those of ordinary skill in the art without departing from the design spirit of the present invention, should fall within the protection scope determined by the claims of the present invention.

The invention claimed is:

1. A type of energy-absorbing rock bolt device with umbrella-shaped structure, comprising a body of bolt (1), one end of the body of bolt (1) being equipped with a preloaded system (4), the other end of the body of bolt (1) being equipped with a first support system (2), the body of bolt (1) being equipped with several second support systems (3), and the several second support systems (3) being located between the preloaded system (4) and the first support system (2);

wherein each of the second support systems (3) comprises a first umbrella-shaped support system and a second umbrella-shaped support system;

wherein an end of the first umbrella-shaped support system close to the preloaded system (4) is fixedly connected to the body of bolt (1), another end of the first umbrella-shaped support system away from the preloaded system (4) is threadedly connected to the body of bolt (1), and the second umbrella-shaped support system is threadedly connected to the body of bolt (1);

wherein the first umbrella-shaped support system comprises a first fixed block (3.1), a first nut (3.3) and a first interconnecting piece; the first fixed block (3.1) is muff-coupled with the body of bolt (1), both sides of the first fixed block (3.1) are equipped with shoulders (3.2), and the shoulders (3.2) are fixedly connected to the body of bolt (1); the first nut (3.3) is threadedly connected to the body of bolt (1), the first interconnecting piece comprises a first connecting rod (3.4) and a second connecting rod (3.5), a sliding sleeve (3.6) is slidingly connected to the second connecting rod (3.5), and the sliding sleeve (3.6) is articulated to one end of the first connecting rod (3.4), the other end of the first connecting rod (3.4) is articulated to the first nut (3.3), and the second connecting rod (3.5) is articulated to the first fixed block (3.1).

2. The energy-absorbing rock bolt device with umbrella-shaped structure according to claim 1, wherein the second umbrella-shaped support system comprises a second nut (3.7), a third nut (3.8) and a second interconnecting piece; the second nut (3.7) and the third nut (3.8) are individually threadedly connected to the body of bolt (1), and the second interconnecting piece comprises a third connecting rod (3.9), a fourth connecting rod (3.10), a fifth connecting rod (3.11) and a sixth connecting rod (3.12); one end of the third connecting rod (3.9) and one end of the sixth connecting rod (3.12) are respectively articulated to the second nut (3.7) and the third nut (3.8); the third connecting rod (3.9), the fourth connecting rod (3.10), the fifth connecting rod (3.11) and the sixth connecting rod (3.12) are respectively connected end to end in sequence.

3. The energy-absorbing rock bolt device with umbrella-shaped structure according to claim 2, wherein internal threads arranged on the first nut (3.3) and the third nut (3.8) are in a same direction, and internal threads arranged on the second nut (3.3) and the third nut (3.8) are in opposite directions.

4. The energy-absorbing rock bolt device with umbrella-shaped structure according to claim 2, wherein Y-shaped support frames (3.13) are symmetrically arranged at an articulation point of the third connecting rod (3.9) and the fourth connecting rod (3.10) and an articulation point of the fifth connecting rod (3.11) and the sixth connecting rod (3.12), a conical block (3.14) is arranged at an articulation point of the fourth connecting rod (3.10) and the fifth connecting rod (3.11), the Y-shaped support frames (3.13) and the conical block (3.14) are all arranged radially based upon taking a shaft axis of the body of bolt (1) as a center.

5. The energy-absorbing rock bolt device with umbrella-shaped structure according to claim 2, wherein the first interconnecting piece and the second interconnecting piece are all arranged in a circular array based upon taking a shaft axis of the body of bolt (1) as a center.

6. The energy-absorbing rock bolt device with umbrella-shaped structure according to claim 1, wherein the first support system (2) comprises a second fixed block (2.1), two expansion shell pieces (2.2) symmetrically arranged on upper and lower sides of the second fixed block (2.1), and a U-shaped shackle (2.3) fixedly connected to outer sides of the two expansion shell pieces (2.2); the two expansion shell pieces (2.2) are integrated together via the U-shaped shackle (2.3), an outer side of the U-shaped shackle (2.3) is fastened with a strapping tape (2.4), the second fixed block (2.1) is fixedly connected to the body of bolt (1), an outer side of the second fixed block (2.1) is formed with a conical surface, and one end of the expansion shell piece (2.2) close to the second fixed block (2.1) is matched with the conical surface; internal threads are arranged on an inner side of the expansion shell piece (2.2), external threads are arranged on an outer side of the second fixed block (2.1), and the internal threads are matched with the external threads; and several wedge blocks (2.2.1) are fixedly connected at intervals onto the outer side of the expansion shell piece (2.2).

7. The energy-absorbing rock bolt device with umbrella-shaped structure according to claim 6, wherein a through hole (2.3.1) is formed on a left side of the U-shaped shackle (2.3), springs (2.3.2) are symmetrically arranged on upper and lower sides of the through hole (2.3.1), and steel balls (2.3.3) are symmetrically arranged on the upper and lower sides of the through hole (2.3.1); one end of the spring (2.3.2) is fixedly connected to a side surface of the through hole (2.3.1), and the other end of the spring (2.3.2) is fixedly connected to the steel ball (2.3.3); the body of bolt (1) passes through the through hole (2.3.1), a circular groove (1.1) is formed on an end of the body of bolt (1) close to the U-shaped shackle (2.3), and the circular groove (1.1) is matched with the steel balls (2.3.3).

8. The energy-absorbing rock bolt device with umbrella-shaped structure according to claim 1, wherein the preloaded system (4) comprises a supporting plate (4.1) and a fourth nut (4.2); the supporting plate (4.1) is fixedly connected to the body of bolt (1), and the fourth nut (4.2) is threadedly connected to the body of bolt (1).

9. The energy-absorbing rock bolt device with umbrella-shaped structure according to claim 8, wherein an end of the body of bolt (1) away from the supporting plate (4.1) is fixedly connected with a resin stirrer.

10. A type of energy-absorbing rock bolt device with umbrella-shaped structure, comprising a body of bolt (1), one end of the body of bolt (1) being equipped with a preloaded system (4), the other end of the body of bolt (1) being equipped with a first support system (2), the body of bolt (1) being equipped with several second support systems (3), and the several second support systems (3) being located between the preloaded system (4) and the first support system (2);

wherein each of the second support systems (3) comprises a first umbrella-shaped support system and a second umbrella-shaped support system;

wherein an end of the first umbrella-shaped support system close to the preloaded system (4) is fixedly connected to the body of bolt (1), another end of the first umbrella-shaped support system away from the preloaded system (4) is threadedly connected to the body of bolt (1), and the second umbrella-shaped support system is threadedly connected to the body of bolt (1);

wherein the first support system (2) comprises a second fixed block (2.1), two expansion shell pieces (2.2) symmetrically arranged on upper and lower sides of the second fixed block (2.1), and a U-shaped shackle (2.3) fixedly connected to outer sides of the two expansion shell pieces (2.2); the two expansion shell pieces (2.2) are integrated together via the U-shaped shackle (2.3), an outer side of the U-shaped shackle (2.3) is fastened with a strapping tape (2.4), the second fixed block (2.1) is fixedly connected to the body of bolt (1), an outer side of the second fixed block (2.1) is formed with a conical surface, and one end of the expansion shell piece (2.2) close to the second fixed block (2.1) is matched with the conical surface; internal threads are arranged on an inner side of the expansion shell piece (2.2), external threads are arranged on an outer side of the second fixed block (2.1), and the internal threads are matched with the external threads; and several wedge blocks (2.2.1) are fixedly connected at intervals onto the outer side of the expansion shell piece (2.2).

11. The energy-absorbing rock bolt device with umbrella-shaped structure according to claim 10, wherein a through hole (2.3.1) is formed on a left side of the U-shaped shackle (2.3), springs (2.3.2) are symmetrically arranged on upper and lower sides of the through hole (2.3.1), and steel balls (2.3.3) are symmetrically arranged on the upper and lower sides of the through hole (2.3.1); one end of the spring (2.3.2) is fixedly connected to a side surface of the through hole (2.3.1), and the other end of the spring (2.3.2) is fixedly connected to the steel ball (2.3.3); the body of bolt (1) passes through the said through hole (2.3.1), a circular groove (1.1) is formed on an end of the body of bolt (1) close to the U-shaped shackle (2.3), and the circular groove (1.1) is matched with the steel balls (2.3.3).

12. The energy-absorbing rock bolt device with umbrella-shaped structure according to claim 10, wherein the preloaded system (4) comprises a supporting plate (4.1) and a fourth nut (4.2); the supporting plate (4.1) is fixedly connected to the body of bolt (1), and the fourth nut (4.2) is threadedly connected to the body of bolt (1).

13. The energy-absorbing rock bolt device with umbrella-shaped structure according to claim 12, wherein an end of the body of bolt (1) away from the supporting plate (4.1) is fixedly connected with a resin stirrer.

* * * * *